US009206798B2

(12) United States Patent
Jung

(10) Patent No.: US 9,206,798 B2
(45) Date of Patent: Dec. 8, 2015

(54) HYDRAULIC PUMP CONTROL APPARATUS AND METHOD OF CONSTRUCTION MACHINE

(75) Inventor: Woo Yong Jung, Seoul (KR)

(73) Assignee: Doosan Infracore Co., Ltd., Incheon (KR)

( * ) Notice: Subject to any disclaimer, the term of this patent is extended or adjusted under 35 U.S.C. 154(b) by 431 days.

(21) Appl. No.: 13/519,032

(22) PCT Filed: Dec. 21, 2010

(86) PCT No.: PCT/KR2010/009140

§ 371 (c)(1),
(2), (4) Date: Jun. 25, 2012

(87) PCT Pub. No.: WO2011/078543

PCT Pub. Date: Jun. 30, 2011

(65) Prior Publication Data

US 2012/0263604 A1 Oct. 18, 2012

(30) Foreign Application Priority Data

Dec. 23, 2009 (KR) ..... 10-2009-0130246

(51) Int. Cl.
*F04B 49/10* (2006.01)
*F04B 49/00* (2006.01)
(Continued)

(52) U.S. Cl.
CPC ..... *F04B 49/002* (2013.01); *E02F 9/2235* (2013.01); *F04B 17/05* (2013.01); *F04B 49/065* (2013.01); *F04B 2203/0603* (2013.01); *F04B 2203/0605* (2013.01)

(58) Field of Classification Search
CPC ..... F04B 1/295; F04B 9/08; F04B 49/065; F04B 49/10; F04B 49/106; F04B 49/002; F04B 17/05; F04B 2203/0604; F04B 2203/0605; E02F 9/2235
USPC ..... 417/1–47, 212–223, 269–270, 417/279–311; 60/449
See application file for complete search history.

(56) References Cited

U.S. PATENT DOCUMENTS 4,904,161 A * 2/1990 Kamide et al. ..... 417/22
6,708,787 B2 * 3/2004 Naruse et al. ..... 180/53.8
(Continued)

FOREIGN PATENT DOCUMENTS

JP 2752501 2/1998
JP 2002-188177 A 7/2002
(Continued)

OTHER PUBLICATIONS

Full Machine Translation of Japanese Patent document JP-2004190582 cited in applicant's IDS.*
Search Report dated Sep. 29, 2011 written in Korean with English translation attached for International Application No. PCT/KR2010/009140, filed Dec. 21, 2010, 7 pages.

*Primary Examiner* — Peter J Bertheaud
*Assistant Examiner* — Dnyanesh Kasture
(74) *Attorney, Agent, or Firm* — John D. Veldhuis-Kroeze; Westman, Champlin & Koehler, P.A.

(57) ABSTRACT

In a hydraulic pump control apparatus and method of a construction machine, the control apparatus includes a pump control unit for controlling discharge pressure of a pump driven by an engine. The control unit includes: a pressure setting value calculating unit which calculates a pressure setting value based on an engine output torque estimating value or an engine RPM; and a breakdown treating unit selects one of the pressure setting value and a pressure command value according to a breakdown of the swash plate angle sensor to output the selected value. Since the pump is controlled according to a pressure setting value calculated based on the engine output torque estimating value, the absorption torque value of the pump does not exceed the maximum torque value of the engine even when the swash plate angle sensor breaks down, and related engine stoppage is prevented even during a high-load operation.

6 Claims, 6 Drawing Sheets

(51) Int. Cl.

| | |
|---|---|
| ***E02F 9/22*** | (2006.01) |
| ***F04B 17/05*** | (2006.01) |
| ***F04B 49/06*** | (2006.01) |

(56) References Cited

U.S. PATENT DOCUMENTS 8,162,618 B2 * 4/2012 Nakamura et al. ..... 417/34
2007/0227137 A1 * 10/2007 Naruse ..... 60/426

FOREIGN PATENT DOCUMENTS

| | | | |
|---|---|---|---|
| JP | 2004-190582 | A | 7/2004 |
| JP | 2006-169974 | A | 6/2006 |
| KR | 10-2009-0069592 | A | 7/2009 |

* cited by examiner

HYDRAULIC PUMP CONTROL APPARATUS AND METHOD OF CONSTRUCTION MACHINE

This Application is a Section 371 National Stage Application of International Application No. PCT/KR2010/009140, filed Dec. 21, 2010 and published, not in English, as WO2011/078543 on Jun. 30, 2011.

FIELD OF THE DISCLOSURE

The present disclosure relates to a hydraulic pump control apparatus and a hydraulic pump control method of a construction machine, and more particularly, to a hydraulic pump control apparatus and a hydraulic pump control method of a construction machine including a hydraulic pump which is driven by an engine and of which an absorption torque is varied according to a control signal.

BACKGROUND OF THE DISCLOSURE

A swash plate angle sensor for detecting an angle of a swash plate is provided to electronically control a hydraulic pump. A pump control unit calculates a discharge flow rate of a pump by using the detected swash plate angle to calculate a pressure command value of the hydraulic pump, and issues a command. However, when the swash plate angle sensor breaks down, the pump control unit cannot recognize a discharge flow rate of the pump. Accordingly, since the pump control unit cannot calculate a pressure command value, the pump control unit generally outputs a pressure arbitrarily set in advance, that is, a pressure setting value as a command.

However, in this case, when a load pressure applied to an actuator of the construction machine is higher than the pressure setting value set in the hydraulic pump, the actuator cannot be operated. In contrast, when the pressure setting value is higher than a load pressure, a required flow rate becomes larger. Accordingly, a discharge flow rate of the pump increases, and thus an absorption torque value of the pump also increases. In the latter case, if an absorption torque value of the pump becomes larger than a maximum torque value of the engine, a phenomenon of stopping the engine occurs.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

The present disclosure has been made in an effort to solve the problem of the related art, and it is an object of the present disclosure to provide a hydraulic pump control apparatus of a construction machine which secures stability of a machine by preventing an engine from being stopped even when a swash plate angle sensor breaks down.

In order to achieve the above object, an exemplary embodiment of the present disclosure provides a hydraulic pump control apparatus of a construction machine including a pump control unit for controlling a discharge pressure of a hydraulic pump driven by an engine, wherein the pump control unit includes: a pressure setting value calculating unit configured to calculate a pressure setting value based on an engine output torque estimating value or an engine RPM; and a breakdown treating unit configured to select one of the pressure setting value and a pressure command value according to a breakdown of the swash plate angle sensor to output the selected value.

The pressure setting value calculating unit includes: a torque/RPM difference value calculating unit configured to compare the engine output torque estimating value or the engine RPM with an engine output torque setting value or an engine RPM setting value to calculate a torque difference value or an RPM difference value; a pressure range setting unit configured to set a pressure range value for an operation of a manipulation unit in response to a manipulation signal; a target pressure setting unit configured to receive the torque difference value or the RPM difference value and the pressure range value to set a target pressure value; and a pressure setting value calculating unit configured to calculate a pressure setting value based on the target pressure value.

The pressure setting value calculating unit further includes a pressure change inclination setting unit configured to set a pressure change inclination according to a change rate of a magnitude of a load magnitude estimated by the torque difference value or the RPM difference value, and the pressure setting value calculating unit calculates the pressure setting value by using the target pressure value and the pressure change inclination.

The breakdown treating unit includes: a breakdown determining unit configured to determine a breakdown of the swash plate angle sensor according to an input of the pump discharge flow rate; and a pressure selecting unit configured to select one of the pressure setting value and the pressure command value to output the selected value, and the pressure selecting unit outputs the pressure command value during a normal operation of the swash plate angle sensor, and outputs the pressure setting value during a breakdown of the swash plate angle sensor.

Meanwhile, another exemplary embodiment of the present disclosure provides a hydraulic pump control method of a construction machine for controlling a discharge pressure of a hydraulic pump driven by an engine, including: calculating a pressure setting value based on an engine output torque estimating value or an engine RPM; and selecting one of the pressure setting value and a pressure command value according to a breakdown of the swash plate angle sensor to output the selected value.

The calculating of the pressure setting value includes: comparing the engine output torque estimating value or the engine RPM with an engine output torque setting value or an engine RPM setting value to calculate a torque difference value or an RPM difference value; setting a pressure range value for an operation of a manipulation unit in response to a manipulation signal; receiving the torque difference value or the RPM difference value and the pressure range value to set a target pressure value; and calculating a pressure setting value based on the target pressure value.

The calculating of the pressure setting value further includes setting a pressure change inclination according to a change rate of a load magnitude estimated by the torque difference value or the RPM difference value, and in the calculating of the pressure setting value, the pressure setting value is calculated by using the target pressure value and the pressure change inclination.

The treating of the breakdown includes: determining a breakdown of the swash plate angle sensor according to an input of the pump discharge flow rate; and selecting one of the pressure setting value and the pressure command value to output the selected value, and in the selecting of the pressure, the pressure command value is output during a normal operation of the swash plate angle sensor, and the pressure setting value is output during a breakdown of the swash plate angle sensor.

According to the present disclosure, since a pressure setting value is calculated based on an output torque estimating value or an RPM of an engine such that a pump is controlled according to the calculated pressure setting value, an absorption torque value of the pump can be prevented from exceeding a maximum torque value of the engine even when a swash plate angle sensor breaks down. Thus, a phenomenon of stopping the engine can be prevented even when a swash plate angle sensor breaks down during a high-load operation of the engine.

Further, according to the present disclosure, since a pressure setting value is inversely estimated according to a load (a load pressure applied to an actuator) of an engine, the pressure setting value is also varied according to a load change of the engine. Thus, the engine is prevented from being stopped regardless of a magnitude of a load or a state of the engine.

In addition, according to the present disclosure, since a pressure setting value for a target pressure value is calculated by setting a pressure change inclination of a pump according to an engine output torque difference value or an engine RPM difference value, a reaction speed according to a magnitude of a load can be optimized.

Figure 1:
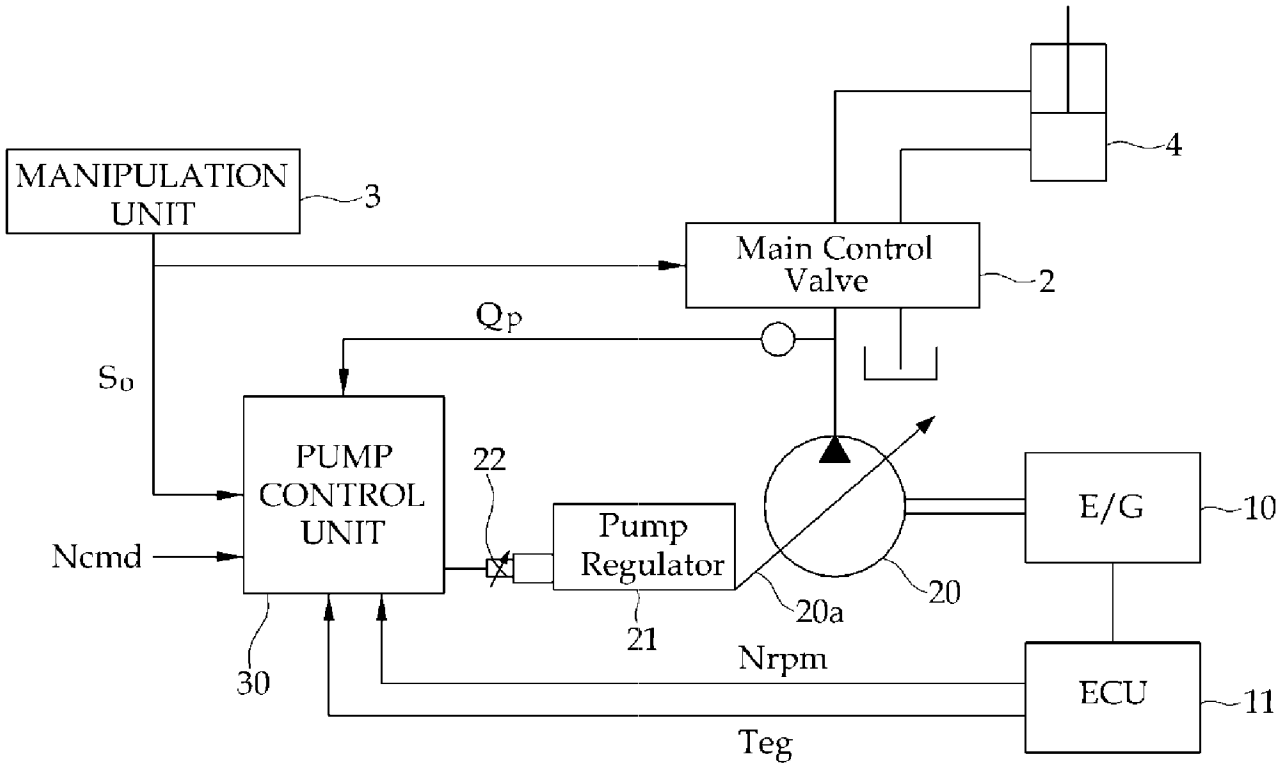
FIG. 1 is a block diagram schematically illustrating a configuration of a hydraulic pump control apparatus of a construction machine according to an exemplary embodiment of the present disclosure.

10: Engine 20: Pump
30: Pump control unit
31: Manipulation unit requiring flow rate calculating unit
32: Flow rate difference value calculating unit
33: Manipulation signal pressure command value calculating unit
34: Maximum suction torque value calculating unit
35: Horse power control pressure command value calculating unit
36: Pressure minimum value calculating unit
37: Pressure setting value calculating unit
37a: Torque/RPM difference value calculating unit
37b: Pressure range setting unit
37c: Target pressure setting unit
37d: Pressure change inclination setting unit
37e: Pressure setting value calculating unit
38: Breakdown treating unit
38a: Breakdown determining unit 38b: Pressure selecting unit

DETAILED DESCRIPTION

Hereinafter, exemplary embodiments of the present disclosure will be described in detail with reference to the accompanying drawings.

FIG. 1 is a block diagram schematically illustrating a construction of a hydraulic pump control apparatus of a construction machine according to an exemplary embodiment of the present disclosure. Referring to FIG. 1, the hydraulic pump control apparatus of a construction machine according to the exemplary embodiment of the present disclosure includes a pump control unit 30 for controlling a discharge pressure of a hydraulic pump 20 directly connected to an engine 10.

The hydraulic pump 20 includes a swash plate 20*a*, and a pump discharge flow rate Qp of the hydraulic pump 20 is varied according to an inclination angle of the swash plate 20*a*, that is, a swash plate angle. A swash plate angle sensor (not illustrated) is installed in the swash plate 20*a*, and calculates a discharge flow rate Qp of the hydraulic pump 20 which is proportional to the detected swash plate angle and transmits the calculated discharge flow rate Qp of the hydraulic pump 20 to the pump control unit 30. Meanwhile, a regulator 21 is installed in the hydraulic pump 20 to regulate the swash plate angle of the hydraulic pump 20, and an electronic proportional control valve 22 is installed in the regulator 21. A control signal (current value) for controlling the electronic proportional control valve 22 is output from the pump control unit 30. A flow direction of a working fluid discharged from the hydraulic pump 20 is controlled by a main control valve 2, and the working fluid whose flow direction has been controlled is supplied to a working tool cylinder 4. The main control valve 2 is converted in response to a signal applied from a manipulation unit 3 to control a flow direction of the working fluid.

The drive of the engine 10 is controlled by an engine control unit (ECU) 11. The ECU 11 transmits an engine RPM Nrmp and an engine output torque estimating value Teg to the pump control unit 30 to achieve a type of feedback control. The engine output torque estimating value Teg may be obtained by a ratio of a current fuel injection amount to a maximum injection fuel amount. The pump control unit 30 receives a command engine RPM Nrpm and compares the received command engine RPM Nrpm with the engine RPM Nrmp input from the ECU 11, and performs a speed sensing control or a horse power control which will be described below. The pump control unit 30 calculates a pressure setting value Ps (FIG. 2) based on the engine output torque estimating value Teg or the engine RPM Nrmp. If the swash plate sensor breaks down, a breakdown treating unit 38 (FIG. 2) of the pump control unit 30 outputs a current value Icmd (FIG. 2) corresponding to the pressure setting value Ps to the electronic proportional control valve 20 while taking the pressure setting value Ps calculated based on the engine output torque estimating value Teg or the engine RPM Nrmp as a command. The process of calculating the pressure setting value Ps will be described in more detail with reference to FIGS. 2 to 4.

Figure 2:
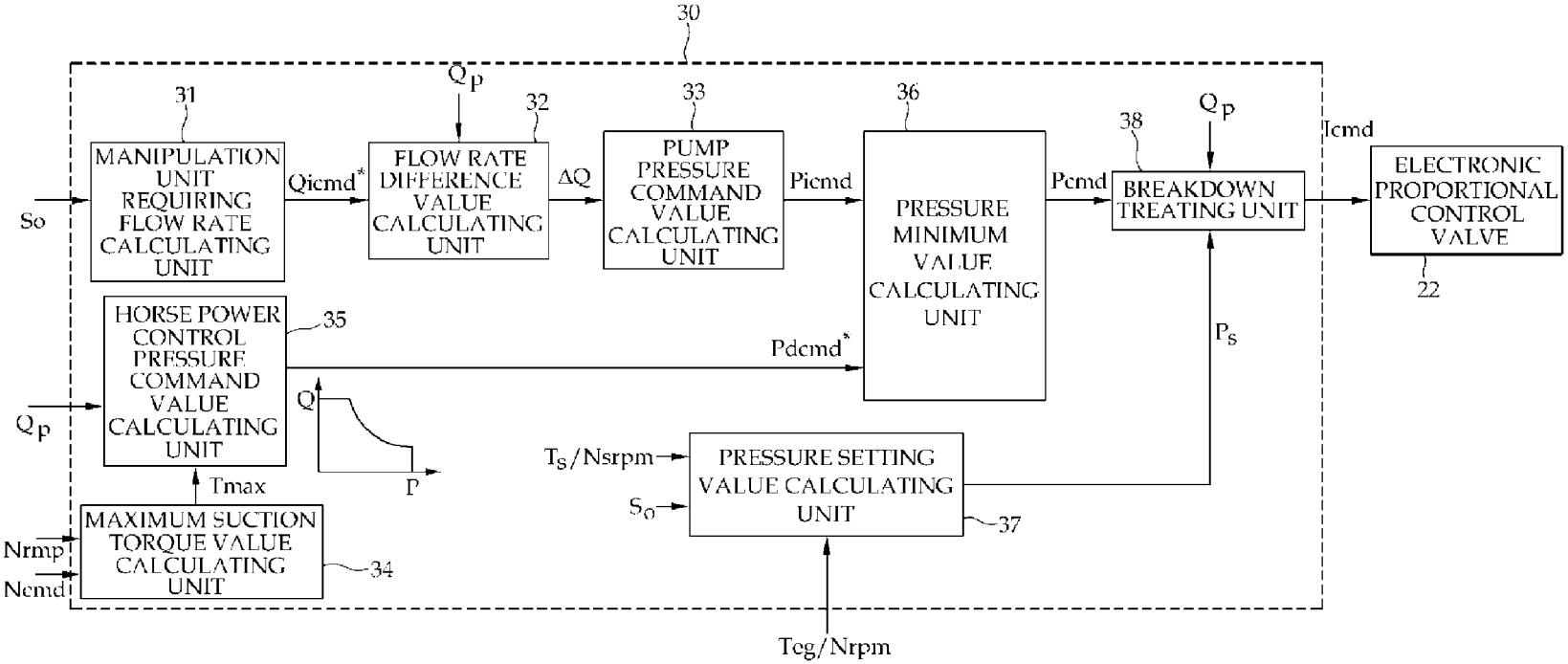
FIG. 2 is a block diagram illustrating an internal structure of a pump control unit of FIG. 1.

FIG. 2 is a block diagram illustrating an internal structure of the pump control unit 30 of FIG. 1. Referring to FIG. 2, the pump control unit 30 of the hydraulic pump control apparatus according to the exemplary embodiment of the present disclosure includes a manipulation unit requiring flow rate calculating unit 31 for receiving a manipulation signal So of the manipulation unit 3 to calculate a manipulation unit requiring flow rate Qicmd*, a flow rate difference value calculating unit 32 for receiving the manipulation unit requiring flow rate Qicmd* and a pump discharge flow rate Qp to calculate a difference value between the manipulation unit requiring flow rate Qicmd* and the pump discharge flow rate Qp, and a manipulation signal pressure command value calculating unit 33 for calculating a pressure command value Picmd of the pressure pump 20 base don the calculated flow rate difference value ΔQ. Meanwhile, the pump control unit 30 further includes a maximum suction (absorption) torque value calculating unit 34 for receiving the engine RPM Nrmp and the command engine RPM Ncmd to calculate a maximum absorption torque value of the pressure pump 20 through a speed sensing control or a horse power control, and a horse power pressure command value calculating unit 35 for receiving the calculated maximum absorption torque value Tmax and pump discharge flow rate Qp to calculate the pressure command value Pdcmd* based on a flow rate/pressure line diagram (QP line diagram). Furthermore, the pump control unit 30 further includes a pressure minimum value calculating unit 36 for comparing the pressure command value Picmd calculated based on the manipulation signal So with the pressure command value Pdcmd* calculated through a horse power control to calculate a smaller value, a pressure setting value calculating unit 37 for calculating a pressure setting value Ps based on the engine output torque estimating value Teg or the engine RPM Nrmp, and a breakdown treating unit 38 for determining a breakdown of the swash plate angle sensor according to an input of the pump discharge flow rate Qp, selecting one of the pressure command value Pcmd and the pressure setting value Ps to convert the selected one to a current value Icmd corresponding thereto, and outputting the current value Icmd to the electronic proportional control valve 22. Although it has been described in the present exemplary embodiment that a pressure value is converted into a current value in the breakdown treating unit 38 to be output, a separate converter may be provided to convert a pressure value output from the breakdown treating unit 38 to a current value corresponding thereto in some exemplary embodiments.

Figure 3:
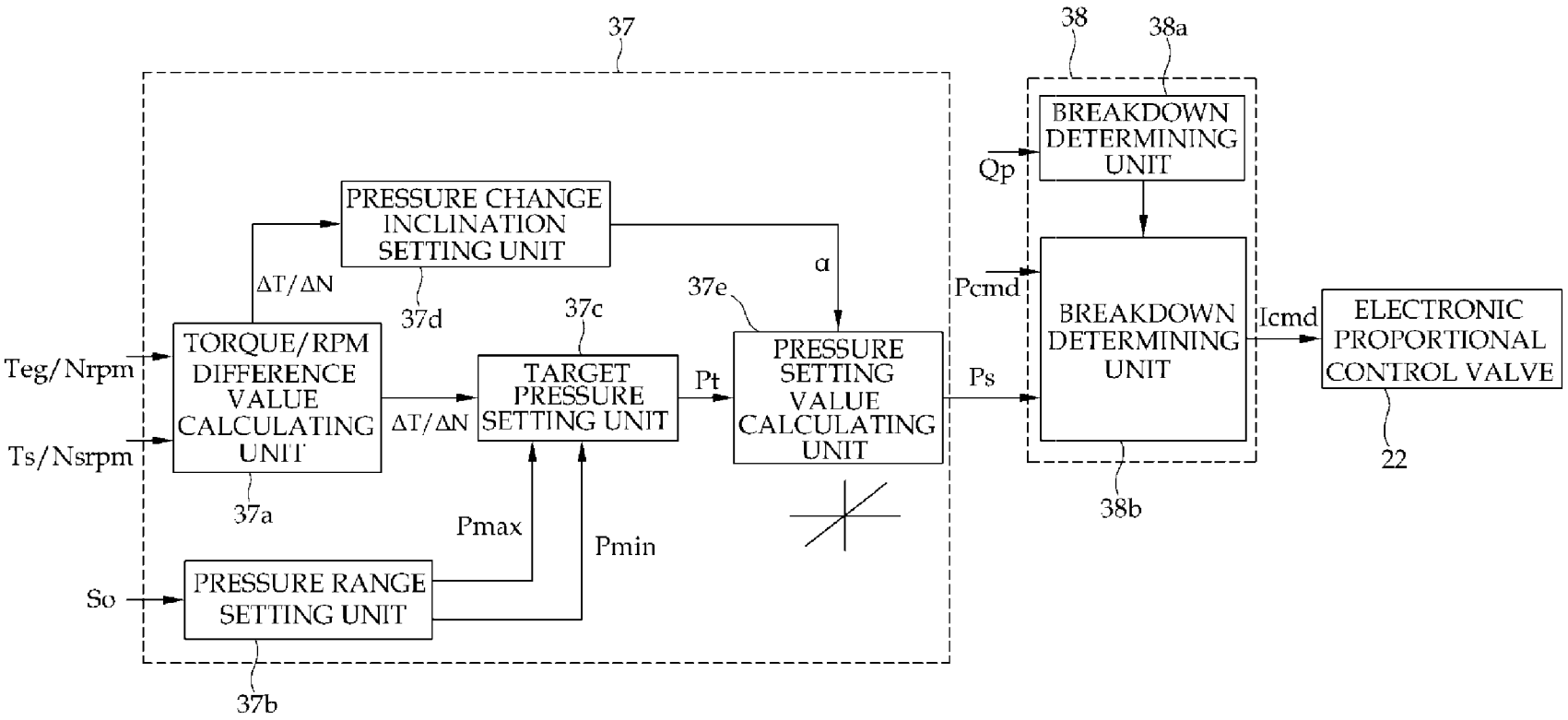
FIG. 3 is a block diagram illustrating internal structures of a pressure setting value calculating unit and a breakdown treating unit of FIG. 2.

FIG. 3 is a block diagram illustrating internal structures of the pressure setting value calculating unit 37 and the breakdown treating unit 38 of FIG. 2. Referring to FIG. 3, the breakdown treating unit 38 according to the exemplary embodiment of the present disclosure includes a breakdown determining unit 38*a* for determining a breakdown of the swash plate angle sensor according to an input of a pump discharge flow rate Qp, and a pressure selecting unit 38*b* for selecting a pressure value according to a breakdown of the swash plate angle sensor and converting the selected pressure value to a current value Icmd corresponding thereto to output the current value Icmd. The pressure selecting unit 38*b* converts and outputs a current value Icmd corresponding to the pressure command value Pcmd during a normal operation of the swash plate angle sensor, and converts and outputs a current value Icmd corresponding to a preset pressure setting value Ps during a breakdown of the swash plate angle sensor.

However, as described above, according to the related art, when the pressure setting value Ps is larger than a load pressure, a pump discharge flow rate Qp increases, also increasing an absorption torque value of the pump. Accordingly, if the absorption torque value of the pressure pump 20 is larger than a maximum torque value of the engine 10, a phenomenon of stopping the engine 10 occurs. In the exemplary embodiment of the present disclosure, in order to solve the problem, as the pressure setting value calculating unit 37 calculates the pressure setting value Ps based on the engine output torque estimating value Teg or the engine RPM Nrmp so that the absorption torque value of the pump does not exceed a maximum torque value of the engine. The configuration of the pressure setting value calculating unit 37 will be described in more detail.

The pressure setting value calculating unit 37 according to the exemplary embodiment of the present disclosure includes a torque/RPM difference value calculating unit 37*a* for comparing an engine output torque estimating value Teg or an engine RPM Nrpm with an engine output torque setting value Ts or an engine RPM setting value Nsrpm to calculate a torque difference value ΔT or an RPM difference value ΔN, a pressure range setting unit 37*b* for setting a pressure range value Pmax~Pmin for each operation of the manipulation unit in response to a manipulation signal So, a target pressure setting unit 37*c* for receiving the torque difference value At or the RPM difference value ΔN and the pressure range value Pmax~Pmin to set a target pressure value Pt from the pressure range value Pmax~Pmin according to an orientation (+/−) of the torque difference value ΔT or the RPM difference value ΔN, and a pressure setting value calculating unit 37*e* for calculating a pressure setting value Ps based on the target pressure value Pt. It is necessary to set a pressure range suitable for various operation characteristics of the manipulation unit 3, that is, a maximum value Pmax and a minimum value Pmin of the pressure in advance. The pressure setting value calculating unit 37 further includes a pressure change inclination setting unit 37*d* for setting a pressure change inclination a according to a change rate of a load magnitude estimated by a torque difference value ΔT or an RPM difference value ΔN to output the set pressure change inclination a to the pressure setting value calculating unit 37*e*. The pressure setting value calculating unit 37*e* calculates a pressure setting value Ps based on the target pressure value Pt and the pressure change inclination a. In more detail, the target pressure value Pt corresponds to a value obtained by adding a pressure setting value increment due to the pressure change inclination a to the pressure setting value Ps. In this way, since a pressure setting value Ps for a target pressure value Pt is calculated by setting a pressure change inclination a of the pump according to a load magnitude, a reaction speed according to the load magnitude can be optimized.

Figure 4:
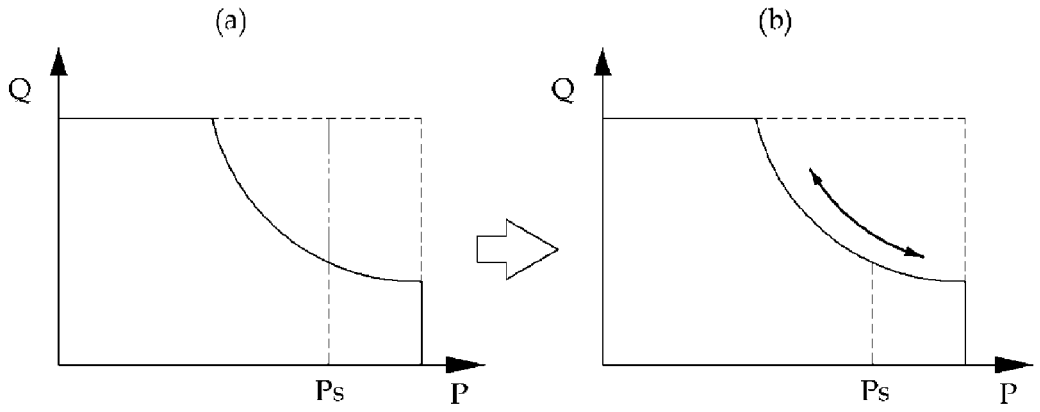
FIG. 4 illustrates graphs for comparing a pressure setting value of FIG. 3 with a pressure setting value according to the related art.

In this way, in the exemplary embodiment of the present disclosure, since the pump is controlled according to a pressure setting value Ps by calculating the pressure setting value Ps based on the engine output torque estimating value Teg in the pressure setting value calculating unit 37, the absorption torque value of the pressure pump 20 does not exceed the maximum torque value of the engine 10 even when the swash plate angle sensor breaks down. That is, in the exemplary embodiment of the present disclosure, since the pressure setting value Ps is changed by an engine output torque value inversely calculated from the load pressure applied to an actuator, a phenomenon of stopping the engine can be prevented even when the swash plate angle sensor breaks down during a high-load operation of the engine. The characteristics of the pressure setting value Ps according to the present disclosure are illustrated in FIG. 4. As illustrated in FIG. 4, while a pressure setting value Ps is fixed to a preset value according to the related art (a), the pressure setting value Ps is inversely estimated according to a load of the engine (a load pressure applied to the actuator) in the present disclosure (b), and therefore, the pressure setting value Ps is also varied according to a load change of the engine. Accordingly, in the present disclosure, the engine is prevented from being stopped regardless of a magnitude of a load or a state of the engine.

Figure 5:
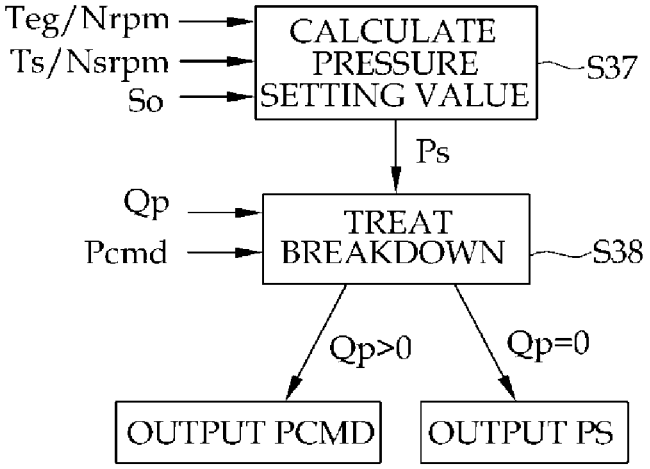
FIG. 5 is a flowchart illustrating a hydraulic pump control method of a construction machine according to an exemplary embodiment of the present disclosure.

FIG. 5 is a flowchart illustrating a hydraulic pump control method of a construction machine according to an exemplary embodiment of the present disclosure. Referring to FIG. 5, the hydraulic pump control method of a construction machine according to the exemplary embodiment of the present disclosure largely includes a pressure setting value calculating step S37 and a breakdown treating step S38. In the pressure setting value calculating step S37, an engine output torque estimating value Teg or an engine RPM Nrmp, an engine output torque setting value Ts or an engine RPM setting value Nsrpm, and a manipulation signal So are input, and a pressure setting value Ps suitable for a magnitude of a load or a state of an engine is calculated. In the breakdown treating step S38, after it is determined whether or not the swash plate angle sensor breaks down according to an input of a pump discharge flow rate Qp, a pressure command value Pcmd is output during a normal operation of the swash plate angle sensor and a pressure setting value Ps is output during a breakdown of the swash plate angle sensor.

Figure 6:
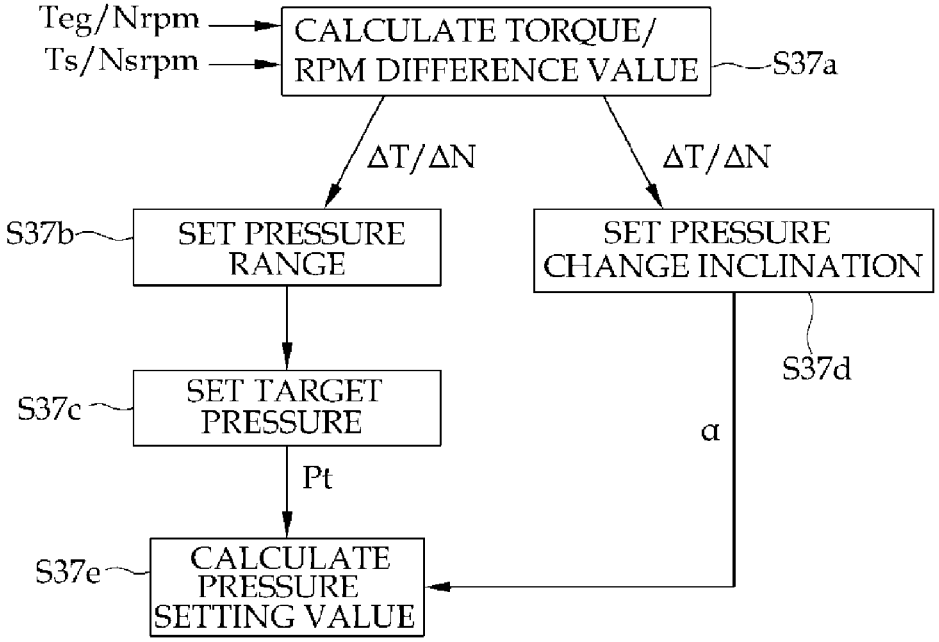
FIG. 6 is a flowchart illustrating sub-steps of a step of calculating a pressure setting value of FIG. 5.

FIG. 6 is a flowchart illustrating sub-steps of the pressure setting value calculating step S37 of FIG. 5. Referring to FIG. 6, the pressure setting value calculating step 37 includes a torque/RPM difference value calculating step S37*a* for comparing an engine output torque estimating value Teg or an engine RPM Nrpm with an engine output torque setting value Ts or an engine RPM setting value Nsrpm to calculate a torque difference value ΔT or an RPM difference value ΔN, a pressure range setting step S37*b* for setting a pressure range value Pmax~Pmin for an operation of the manipulation unit in response to a manipulation signal So, a target pressure setting step S37*c* for receiving the torque difference value Δt or the RPM difference value ΔN and the pressure range value Pmax~Pmin to set a target pressure value Pt, a pressure change inclination setting step S37*d* for setting a pressure change inclination a according to a change rate of a load magnitude estimated by the torque difference value ΔT and the RPM difference value ΔN and a pressure setting value calculating step S37*e* for calculating a pressure setting value Ps based on the target pressure value Pt and a pressure change inclination a.

In this way, in the exemplary embodiment of the present disclosure, since the pump is controlled according to a pressure setting value Ps obtained by calculating the pressure setting value Ps based on the engine output torque estimating value Teg or the engine RPM Nrpm, the absorption torque value of the pump does not exceed the maximum torque value of the engine even when the swash plate angle sensor breaks down. Accordingly, a phenomenon of stopping the engine can be prevented even if the swash plate angle sensor breaks down during a high-load operation of the engine. In other words, according to the exemplary embodiment of the present disclosure, since a pressure setting value Ps is inversely estimated according to a load (a load pressure applied to an actuator) of an engine, the pressure setting value Ps is also varied according to a load change of the engine. Thus, the engine is prevented from being stopped regardless of a magnitude of a load or a state of the engine.

Meanwhile, it should be understood that although the present disclosure has been described with reference to the exemplary embodiments illustrated in the drawings, the exemplary embodiments are illustrative only but those skilled in the art to which the present disclosure pertains can carry out various modifications and equivalent embodiments. Therefore, the technical scope of the present disclosure shall be determined by the attached claims.

Although the present disclosure has been described with reference to exemplary and preferred embodiments, workers skilled in the art will recognize that changes may be made in form and detail without departing from the spirit and scope of the disclosure.

The invention claimed is:

1. A hydraulic pump control apparatus of a construction machine, comprising:

a pump control unit for controlling a discharge pressure of a hydraulic pump driven by an engine, wherein the pump control unit is programmed with: a pressure setting value calculating unit configured to calculate a pressure setting value based on an engine output torque estimating value or an engine RPM; and a breakdown treating unit configured to receive both of the pressure setting value and a pressure command value and to select one of the pressure setting value and the pressure command value depending on whether a swash plate angle sensor is providing a signal or is in breakdown and is not providing a signal, to output the selected value, wherein the pressure command value is calculated based on a calculated flow rate difference value which is a difference value between a pump discharge flow rate and a manipulation unit requiring flow rate.

2. The hydraulic pump control apparatus of claim 1, wherein the pressure setting value calculating unit comprises; a torque/RPM difference value calculating unit configured to compare the engine output torque estimating value or the engine RPM with an engine output torque setting value or an engine RPM setting value to calculate a torque difference value or an RPM difference value; a pressure range setting unit configured to set a pressure range value for an operation of a manipulation unit in response to a manipulation signal a target pressure setting unit configured to receive the torque difference value or the RPM difference value and the pressure range value to set a target pressure value and a pressure setting value calculating unit configured to calculate a pressure setting value based on the target pressure value.

3. The hydraulic pump control apparatus of claim 2, wherein the pressure setting value calculating unit further comprises a pressure change inclination setting unit configured to set a pressure change inclination according to a change rate of a magnitude of a load magnitude estimated by the torque difference value or the RPM difference value and the pressure setting value calculating unit calculates the pressure setting value by using the target pressure value and the pressure change inclination.

4. A hydraulic pump control method of a construction machine for controlling a discharge pressure of a hydraulic pump driven by an engine, comprising:

calculating a pressure setting value based on an engine output torque estimating value or an engine RPM; and receiving both of the pressure setting value and a pressure command value and selecting one of the pressure setting value and the pressure command value depending on whether a swash plate angle sensor is providing a signal or is in breakdown and is not providing a signal, to output the selected value, wherein the pressure value is calculated based on a calculated flow rate difference value which is a difference value between a pump discharge flow rate and a manipulation unit requiring flow rate.

5. The hydraulic pump control method of claim 4, wherein the calculating of the pressure setting value includes: comparing the engine output torque estimating value or the engine RPM with an engine output torque setting value or an engine RPM setting value to calculate a torque difference value or an RPM difference value; setting a pressure range value for an operation of a manipulation unit in response to a manipulation signal; receiving the torque difference value or the RPM difference value and the pressure range value to set a target pressure value; and calculating a pressure setting value based on the target pressure value.

6. The hydraulic pump control method of claim 5, wherein the calculating of the pressure setting value further comprises setting a pressure change inclination according to a change rate of a load magnitude estimated by the torque difference value or the RPM difference value, and in the calculating of the pressure setting value, the pressure setting value is calculated by using the target pressure value and the pressure change inclination.

* * * * *